US007493678B1

(12) United States Patent
Chen

(10) Patent No.: US 7,493,678 B1
(45) Date of Patent: Feb. 24, 2009

(54) METHOD OF INSPECTING CLOTH

(76) Inventor: Ming-Tse Chen, 9F, 270, Chunghsiao E. Road, Sec 4, Taipei (TW)

( * ) Notice: Subject to any disclaimer, the term of this patent is extended or adjusted under 35 U.S.C. 154(b) by 32 days.

(21) Appl. No.: 11/854,544

(22) Filed: Sep. 13, 2007

(51) Int. Cl.
*D06H 3/00* (2006.01)

(52) U.S. Cl. ..... 26/70

(58) Field of Classification Search ..... 26/70, 26/51, 51.4, 51.5, 51.3; 28/140, 100, 299; 346/33 R, 33 F, 45, 50, 51, 20; 356/430; 73/159

See application file for complete search history.

(56) References Cited

U.S. PATENT DOCUMENTS 3,023,480 A * 3/1962 Stephens et al. ..... 26/70
3,094,368 A * 6/1963 Peck ..... 26/70
3,251,112 A * 5/1966 Ingham, Jr. ..... 28/140
3,540,830 A * 11/1970 Dicanio ..... 26/70
3,633,211 A * 1/1972 Batzdorff ..... 346/33 F
3,942,735 A * 3/1976 Marchio et al. ..... 26/70
4,800,503 A * 1/1989 Pierce et al. ..... 26/70
4,853,776 A * 8/1989 Itaya et al. ..... 26/70
4,982,600 A * 1/1991 Kiso et al. ..... 73/159

* cited by examiner

*Primary Examiner*—Amy B Vanatta

(57) ABSTRACT

A method of inspecting cloth includes conveying a continuous cloth by activating a belt transfer device; disposing a transverse label bar assembly on the cloth wherein the label bar assembly is adapted to slide about a transverse label meter on a top edge of the belt transfer device; and in response to finding a defective point of the cloth sliding the label bar assembly to record a distance between the label bar assembly and a left end of the label meter as a value in an X axis, activating a stop watch proximate the top edge of the belt transfer device to record length of the cloth as a value in a Y axis, and representing the defective point as (Xn1, Yn2) where n1 is a number in a range of 1 to a predetermined number, and n2 is the length of the cloth.

2 Claims, 4 Drawing Sheets

METHOD OF INSPECTING CLOTH

1. FIELD OF INVENTION

The invention relates to cloth quality control and more particularly to a method of inspecting cloth by recording defective points of the cloth as Cartesian coordinates in a cloth manufacturing process.

2. DESCRIPTION OF RELATED ART

A conventional method of inspecting cloth in a cloth manufacturing process is illustrated in an apparatus of FIG. 1. A continuous cloth 1' is conveyed by a belt transfer device 3' thereunder. In operation, an employee visually inspects the very slowly running cloth 1' for finding out any defects. The employee may record any defective point by recording its length by activating a stop watch 2' proximate the cloth 1' and describing the defect on a quality control book.

However, the well known method suffers from a disadvantage. In detail, a garment mill buys the produced cloth. An employee of the garment mill may only, for example, know that there is a defect at length, for example, 5.7 m of a cloth roll and its defect description. However, the exact location of the defect is unknown. Thus, the employee has to cut an area of cloth around the defective point. This is not cost effective due to material waste. Thus, the need for improvement still exists.

SUMMARY OF THE INVENTION

It is therefore one object of the invention to provide a method of inspecting cloth by recording defective points of the cloth as Cartesian coordinates in a cloth manufacturing process. The invention can save material and thus is cost effective.

The above and other objects, features and advantages of the invention will become apparent from the following detailed description taken with the accompanying drawings.

DETAILED DESCRIPTION OF THE INVENTION

Figure 1:
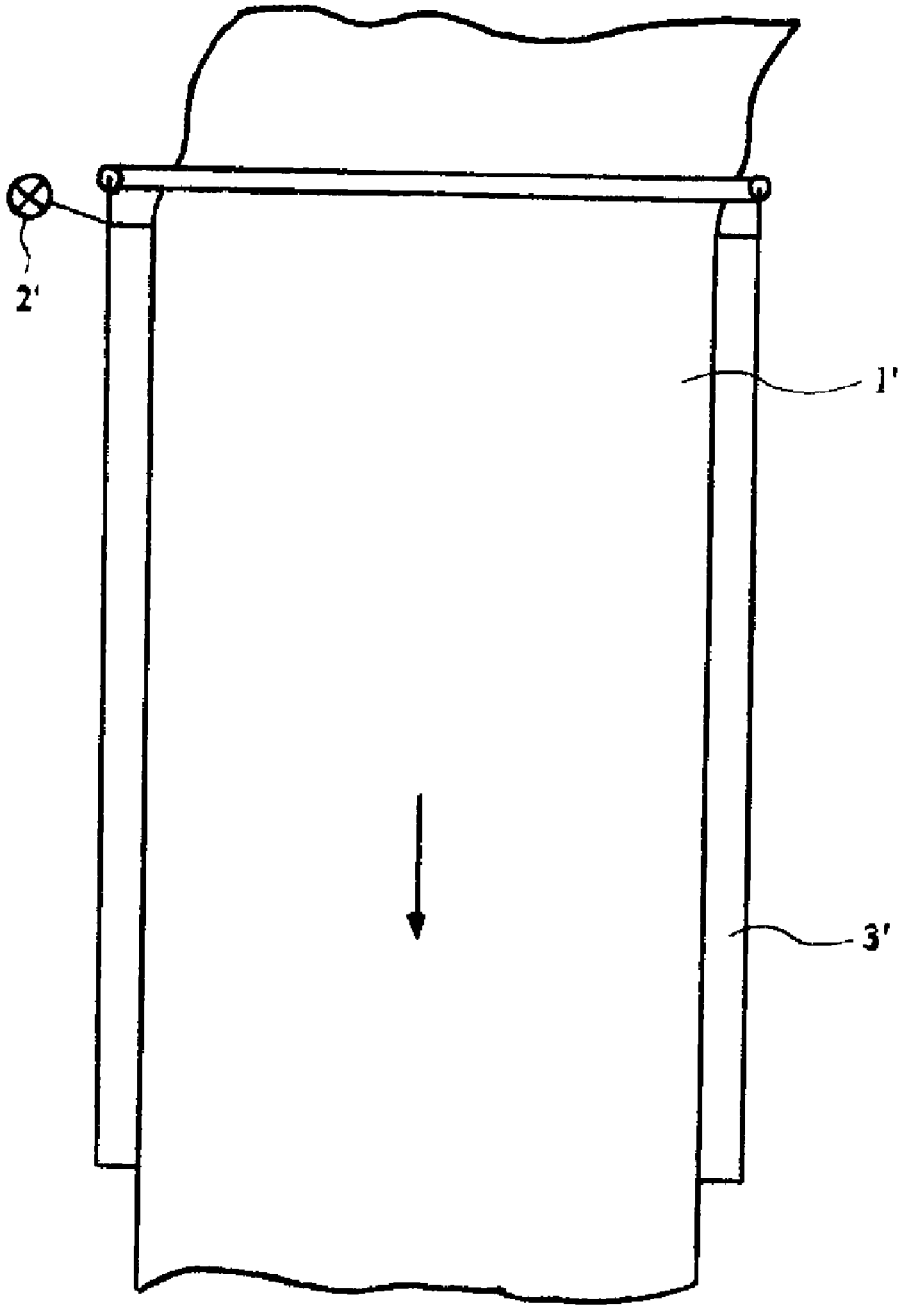
FIG. 1 PRIOR ART
FIG. 1 is a top plan view illustrating a conventional method of inspecting cloth in a cloth manufacturing process.
Figure 2:
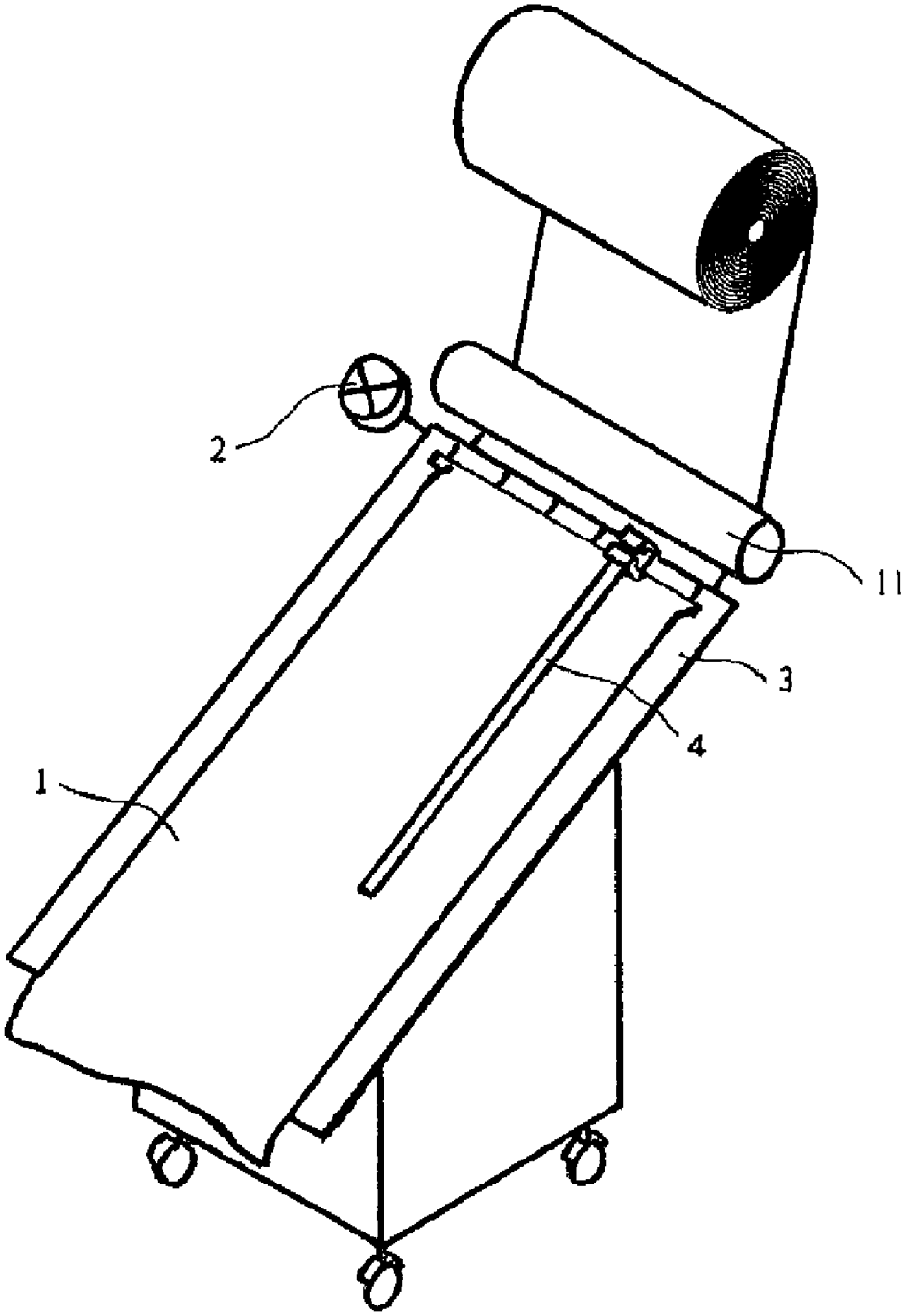
FIG. 2 is a perspective view of an apparatus for inspecting cloth in a cloth manufacturing process according to the invention.
Figure 3:
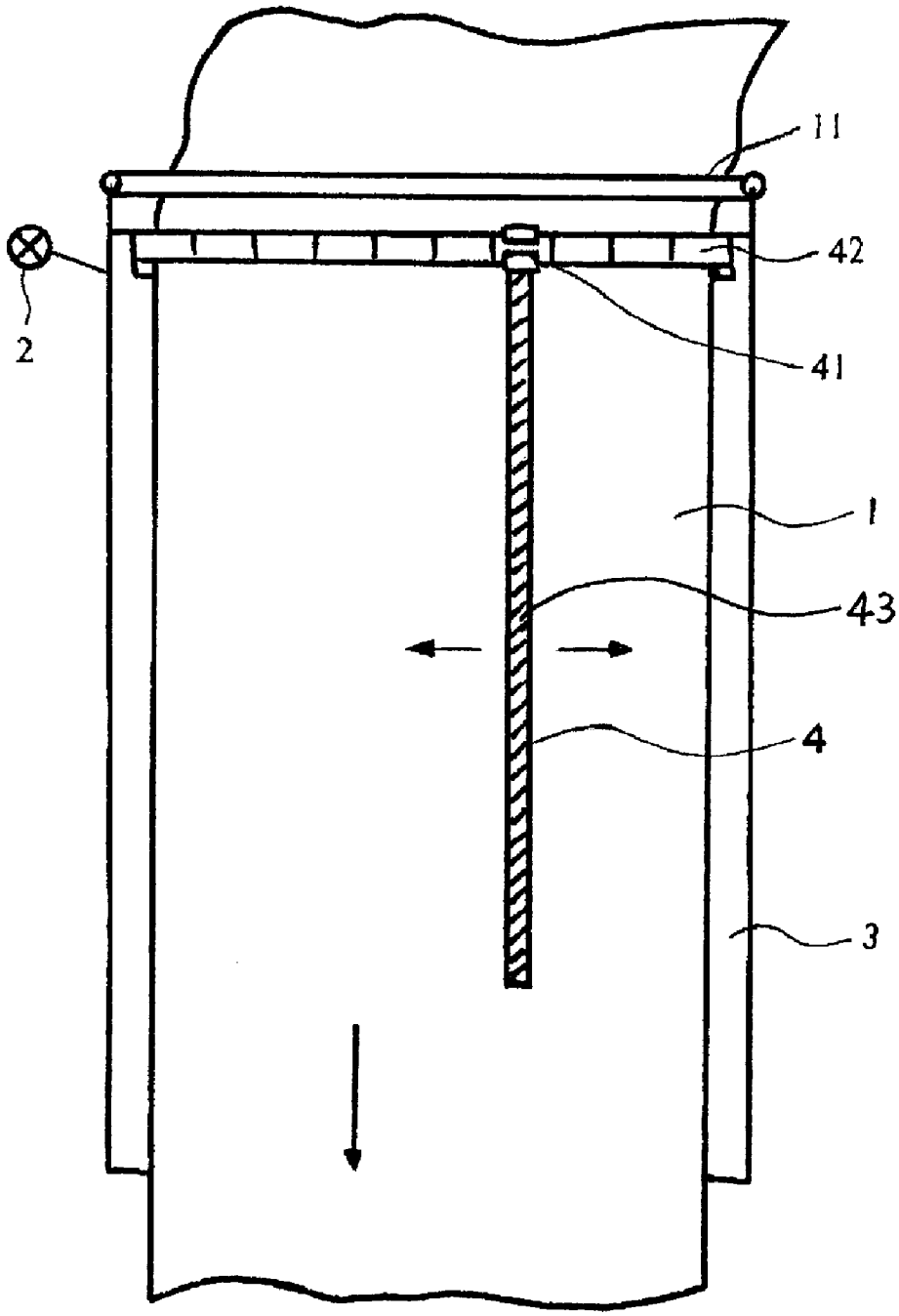
FIG. 3 is a top plan view of FIG. 2.
Figure 4:
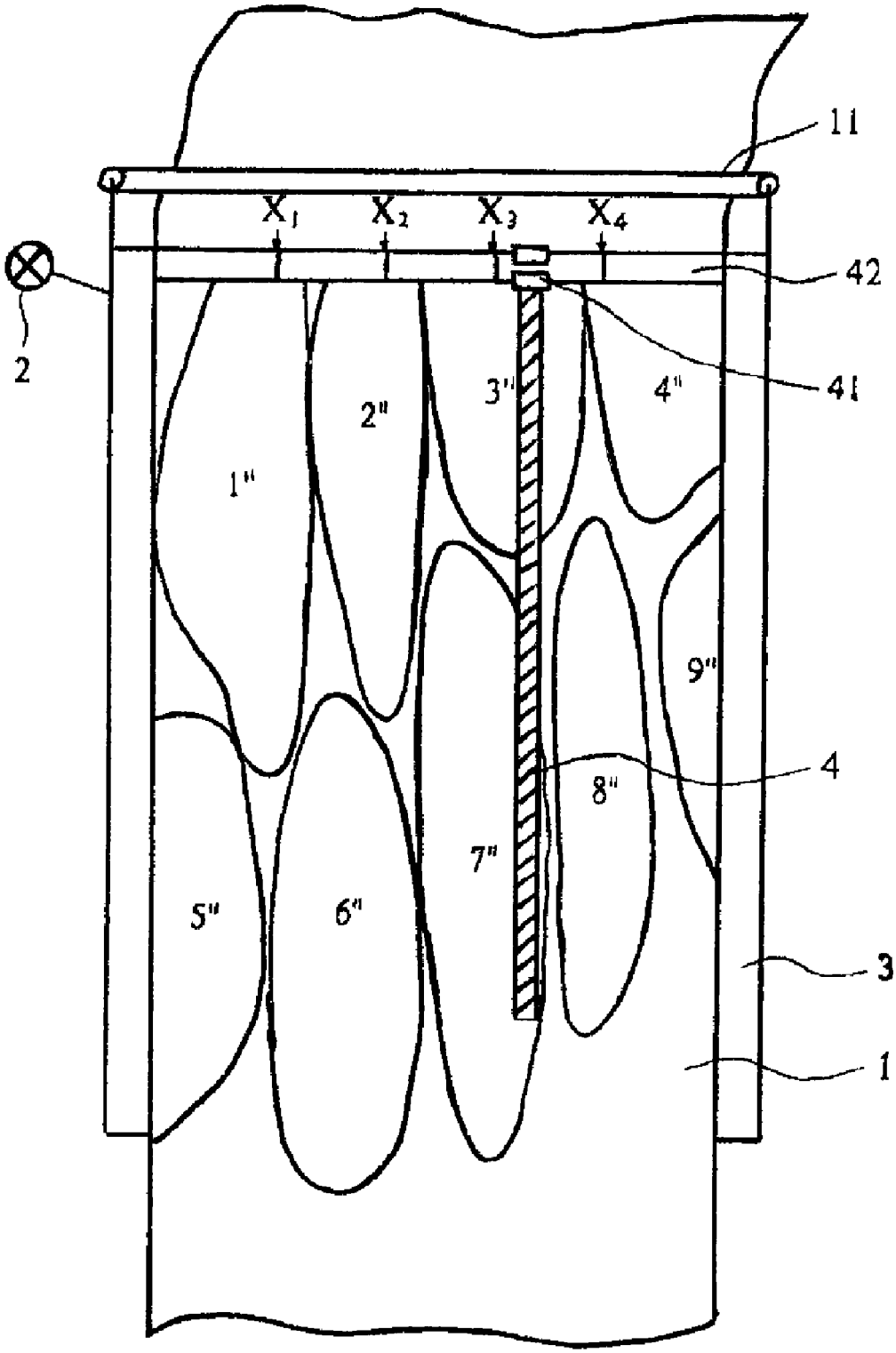
FIG. 4 is a view similar to FIG. 3 illustrating a preferred embodiment of method of inspecting cloth according to the invention by means of the apparatus.

Referring to FIGS. 2 to 4, a method of inspecting cloth in a cloth manufacturing process is performed on an apparatus in accordance with the invention. A continuous cloth 1 is conveyed by a belt transfer device 3 thereunder after being guided by a roll 11. A top surface of the belt transfer device 3 is inclined. A stop watch 2 proximate a top of the belt transfer device 3 in cooperation with the roll 11 is adapted to record length of the slowly running cloth 1 as "Y" value in "Y" axis. Also, a transverse label bar assembly 4 comprises a transverse label meter 42 with printed graduated marks mounted on a top edge of the belt transfer device 3. The transverse label bar assembly 4 further comprises a wedge close seat 41 slidably mounted on the transverse label meter 42. The transverse label bar assembly 4 further comprises a pressing layer 43 adapted to press on the cloth 1.

The transverse label bar assembly 4 is adapted to slide transversely on the cloth 1 by moving the wedge close seat 41 along the transverse label meter 42 to record width of the cloth 1 as "X" value in "X" axis.

In operation, a cloth inspection table is created for recording any defective points of the cloth 1 as below.

| | transverse label meter (Xn) | | | | | |
|---|---|---|---|---|---|---|
| Stop watch (Yn) | X1 | X2 | X3 | X4 | Xn | Description |
| Y1 | (X1, Y1) | (X2, Y1) | (X3, Y1) | (X4, Y1) | (Xn, Y1) | |
| Y2 | (X1, Y2) | (X2, Y2) | (X3, Y2) | (X4, Y2) | (Xn, Y2) | |
| Y3 | (X1, Y3) | (X2, Y3) | (X3, Y3) | (X4, Y3) | (Xn, Y3) | |
| Yn | (X1, Yn) | (X2, Yn) | (X3, Yn) | (X4, Yn) | (Xn, Yn) | |

Xn (n = 1, 2, 3, 4, . . . ) is X value (cm) representing width of cloth; and
Yn (n = 1, 2, 3, . . . ) is Y value (cm) representing length of cloth.

It is shown that any defective point of the cloth 1 is expressed as Cartesian coordinates with a brief description. The cloth 1 may be defective due to fiber arrangement fault, discontinuous warp yarn, discontinuous woof yarn, bad edge, jump yarn, hollow weave, weave injure, clothing bad, combined the woof yarn, lack woof, bad edge, not straight clothing edge, oil woof yarn, warp turnaround, loose warp, water stain, woof collapse, square eye, mold spot, mud spot, fault through, different warp, different woof, even woof, even warp, broken hole, dense cloth, hole of jump yarn, spider web, or strong twisting yarn.

Referring to FIG. 4 specifically, a preferred embodiment of the method of inspecting cloth according to the invention by means of the apparatus is illustrated. A portion of the cloth 1 is divided into 9 regions 1", 2", 3", 4", 5", 6", 7", 8" and 9". Any defective point of the cloth 1 can be expressed as Cartesian coordinates in which, for example, a defective point at a length Yn can be expressed as Cartesian coordinates (X1, Yn), (X2, Yn), (X3, Yn) and/or (X4, Yn) which are recorded in a cloth inspection table. Also, a brief description of the defect is recorded on the table. The table is sent to a customer over the Internet by email. In short, a defective point (or area) of the cloth 1 is recorded as at least one of four Cartesian coordinates (X1, Yn), (X2, Yn), (X3, Yn) and (X4, Yn). Therefore, the customer can precisely find the location of any defective point (or area) of the bought cloth 1.

In addition to the above advantage, the invention has the advantages of saving material and reducing cost.

While the invention herein disclosed has been described by means of specific embodiments, numerous modifications and variations could be made thereto by those skilled in the art without departing from the scope and spirit of the invention set forth in the claims.

What is claimed is:

1. A method of inspecting cloth, comprising:

conveying a continuous cloth by activating a belt transfer device;

disposing a transverse label bar assembly on the cloth wherein the label bar assembly is adapted to slide about a transverse label meter on a top edge of the belt transfer device; and in response to finding a defective point of the cloth sliding the label bar assembly to record a distance between the label bar assembly and a left end of the label meter as a value in an X axis, activating a stop watch proximate the top edge of the belt transfer device to record length of the cloth as a value in a Y axis, and representing the defective point as (Xn1, Yn2) where n1 is a number in a range of 1 to a predetermined number, and n2 is the length of the cloth.

2. The method of claim 1, wherein the predetermined number is four.

* * * * *